US011085628B1

(12) United States Patent
Ma et al.

(10) Patent No.: US 11,085,628 B1
(45) Date of Patent: Aug. 10, 2021

(54) MODULAR HEAT DISSIPATION STRUCTURE AND LED LIGHTING DEVICE

(71) Applicant: MESTER LED LIMITED, Shenzhen (CN)

(72) Inventors: Erhua Ma, Shenzhen (CN); Chunjiang Shuai, Shenzhen (CN); Chunhai Wang, Shenzhen (CN)

(73) Assignee: MESTER LED LIMITED, Shenzhen (CN)

( * ) Notice: Subject to any disclaimer, the term of this patent is extended or adjusted under 35 U.S.C. 154(b) by 0 days.

(21) Appl. No.: 17/112,407

(22) Filed: Dec. 4, 2020

(30) Foreign Application Priority Data

Apr. 22, 2020 (CN) ..... 202010319485.6

(51) Int. Cl.

| | |
|---|---|
| ***F21V 29/77*** | (2015.01) |
| ***F21V 21/08*** | (2006.01) |
| ***F21V 29/508*** | (2015.01) |
| *F21Y 115/10* | (2016.01) |

(52) U.S. Cl.
CPC ..... *F21V 29/773* (2015.01); *F21V 21/08* (2013.01); *F21V 29/508* (2015.01); *F21Y 2115/10* (2016.08)

(58) Field of Classification Search
CPC .... F21V 23/06; F21V 23/002; F21V 33/0052; F21V 29/773; F21V 29/508; F21V 29/08; F12Y 2115/10; F21Y 2115/10
See application file for complete search history.

(56) References Cited

U.S. PATENT DOCUMENTS 10,514,155 B2 12/2019 Kim

FOREIGN PATENT DOCUMENTS

| | | | |
|---|---|---|---|
| CN | 202229127 U | | 5/2012 |
| CN | 208349102 U | * | 1/2019 |
| CN | 208349102 U | | 1/2019 |
| CN | 211952698 U | * | 11/2020 |

OTHER PUBLICATIONS

First Office Action in counterpart Chinese Patent Application No. 202010319485.6, dated Jun. 11, 2020.

* cited by examiner

*Primary Examiner* — Anabel Ton
(74) *Attorney, Agent, or Firm* — Westbridge IP LLC

(57) ABSTRACT

Disclosed are a modular heat dissipation structure and an LED lighting device. The modular heat dissipation structure includes a power box configured to accommodate and dissipate a power supply; and a heat sink configured to dissipate a light source; where the heat sink includes a first overlap portion, the power box includes a second overlap portion, the first overlap portion is provided on a side of the heat sink opposite to the second overlap portion and is provided corresponding to the second overlap portion, and the first overlap portion is overlapped above the second overlap portion. The LED lighting device includes the above-mentioned modular heat dissipation structure.

16 Claims, 5 Drawing Sheets

MODULAR HEAT DISSIPATION STRUCTURE AND LED LIGHTING DEVICE

CROSS REFERENCE TO RELATED APPLICATIONS

This disclosure claims the benefit of Chinese Patent Application No. 202010319485.6, filed on Apr. 22, 2020 and entitled "Modular Heat Dissipation Structure and LED Lighting Device", the entirety of which is hereby incorporated herein by reference.

TECHNICAL FIELD

This disclosure provides a modular heat dissipation structure and an LED lighting device thereof, belonging to the field of LED lighting.

BACKGROUND

In the field of LED lighting, heat dissipation performance of lighting devices greatly affects its service life. Therefore, industry technicians have never stopped the research and development and improvement of heat dissipation structures.

The heat sources of LED lighting devices mainly include the following two aspects: one is the heat generated when the LED lamp beads emit light; and the other is the heat generated when the light power supply is working. Among them, the heat generated when the LED lamp beads emit light is greater than the heat generated when the light power supply is working, and the heat of the LED lamp beads is dissipated through a specially arranged heat sink, and the heat of the power supply is dissipated through the power box. In the previous heat dissipation structure of lighting devices, the power box and the heat sink are in direct contact, so a large amount of heat is transferred from the heat sink to the power box, making the heat on the power box far greater than the heat of the power supply itself, thereby shortening the service life of the power supply.

In addition, for LED high-bay lights in related art, the power supply and light source share a heat sink. They have a single installation method and low heat dissipation efficiency. For this reason, there are also some high-bay lights on the market that have made some improvements to the above defects. For example, the Chinese patent application CN201621124141.5 of a new high-bay light discloses a heat dissipation structure in which the power supply and the light source are separated to dissipate heat, which may effectively avoid the problem of low heat dissipation efficiency caused by the shared heat dissipation structure of the power supply and the light source. However, the power box is fixed on an upper side of the heat sink by locking screws from the upper side. Because the installation parts of the high-bay light are also set on the power box, the connection screw between the power box and the heat sink needs to bear a lot of weight in daily use. When the screw thread is damaged, it is easy to cause the heat sink of the high-bay light and the parts below it to fall, which will bring safety hazards. In fact, most of the high-bay lights, mining lamps and other lighting products on the market that adopt the above-mentioned split design also adopt the installation method of the power box being arranged above the heat sink and fixed by screws. Therefore, for related products, the above problems are unavoidable.

SUMMARY

This disclosure provides a modular heat dissipation structure and an LED lighting device thereof, which is convenient to install, has high safety performance during use, and has good heat dissipation performance. The heat of the light source has little effect on the power supply, and the overall service life of the power supply and the lighting device is extended.

One aspect of this disclosure relates to a modular heat dissipation structure, including:

a power box configured to accommodate and dissipate a power supply; and a heat sink configured to dissipate a light source;

where the heat sink includes a first overlap portion, the power box includes a second overlap portion, the first overlap portion is provided on a side of the heat sink opposite to the second overlap portion and is provided corresponding to the second overlap portion, and the first overlap portion is overlapped above the second overlap portion.

Further, the first overlap portion includes first bosses spaced apart from each other on a side opposite to the second overlap portion, the second overlap portion includes second bosses corresponding to the first bosses at a side opposite to the first overlap portion, opposite side walls of the first bosses and the second bosses are abutted against each other, so that a heat insulation gap is defined by the first overlap portion and the second overlap portion at a position staggered from the first bosses and the second bosses.

Further, a heat insulation gasket is further provided between each of the first bosses and the corresponding second boss.

Further, the heat sink includes:

a body, including a first connection portion and a second connection portion spaced apart from the first connection portion; and heat dissipation fins, respectively connected to the first connection portion and the second connection portion to define a heat insulation opening between the first connection portion and the second connection portion;

where the first connection portion is configured to connect the light source, and the first overlap portion is provided on the second connection portion.

Further, the second connection portion defines an installation notch configured for an upper end of the power box to pass through to an upper side of the heat sink, and a periphery of the installation notch is configured as the first overlap portion.

Further, the power box includes a protrusion ring on a side wall, and the protrusion ring is configured as the second overlap portion.

Further, the power box includes a heat dissipation rib at least on a side wall opposite to the installation notch, the installation notch defines a groove adapted to the heat dissipation rib on a peripheral wall corresponding to the heat dissipation rib, and the heat dissipation rib is partially embedded in the groove.

Further, a fastening structure is provided between the first overlap portion and the second overlap portion to limit an axial movement and a circumferential movement between the power box and the heat sink.

Further, the second connection portion defines a heat dissipation opening.

Another aspect of this disclosure relates to an LED lighting device, which includes the modular heat dissipation structure as described above.

The heat dissipation structure of this disclosure adopts a split modular design of the power box to dissipate the power supply and the heat sink to dissipate the light source. A first overlap portion is provided on the heat sink and a second overlap portion is provided on the power box, so as to connect and fix the heat sink and the power box. The first overlap portion is overlapped above the second overlap portion, so that weights of the heat sink and components below the heat sink are carried on the second overlap portion. The second overlap portion of this disclosure has a stronger bearing capacity than the connection screws used in related lighting devices, in which a large part of the weights needs to be carried on the connection screws. Thus the safety performance of this type of lighting device during use is improved.

Because the heat sink and the power box adopt the above-mentioned overlap connection method, by adjusting the overlap position of the heat sink and the power box, the overall height of the heat sink and the power box may be adjusted, and the overall height of the heat sink and the power box may be lowered if necessary to reduce the height and the required space of the lighting device, making the structure of the lighting device more compact.

In addition, the heat sink and the power box of this disclosure are connected in a manner in which the first overlap portion is overlapped above the second overlap portion. Compared with the lock screw connection in related art, the operation is simpler, especially when a manner that heat dissipation ribs and grooves are fitted into each other is introduced, the heat dissipation ribs play a dual role of limiting and guiding when the power box is penetrated into the installation notch, so the installation is convenient.

Further, under the premise that the heat dissipation structure adopts a modular design, the thermal conductivity between the power box and the heat sink has been reduced. In addition, the first bosses and the second bosses abutted against each other are provided between the first connection portion and the second connection portion, so that a heat insulation gap is defined between the first overlap portion and the second overlap portion, thereby reducing the heat conduction between the first connection portion and the second connection portion, that is, the heat transfer from the light source of the lighting device to the power box is reduced. Therefore, this disclosure has better heat dissipation performance, the heat of the light source has little influence on the power supply, and the overall service life of the power supply and the lighting device is extended.

DETAILED DESCRIPTION OF THE EMBODIMENTS

In order to better understand the above technical solutions, the above technical solutions will be described in detail below in conjunction with the accompanying drawings of the specification and specific implementations.

Embodiment 1

Figure 1:
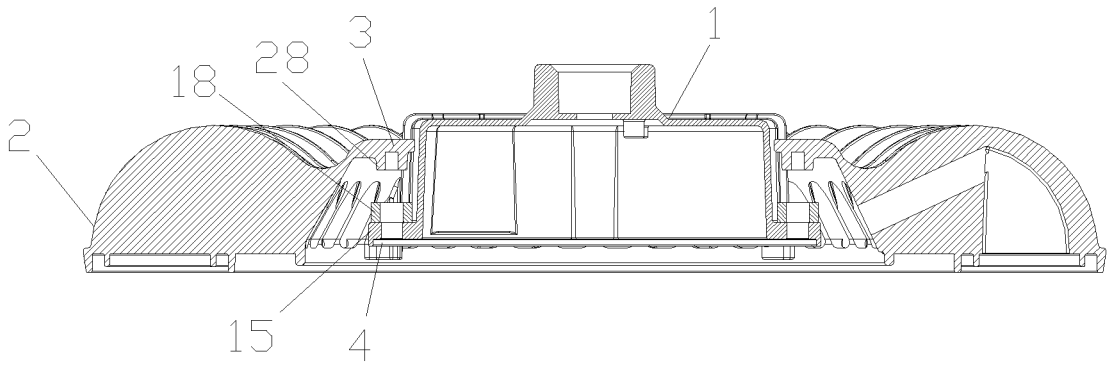
FIG. 1 is a cross-sectional view of a modular heat dissipation structure according to an embodiment of this disclosure.
Figure 2:
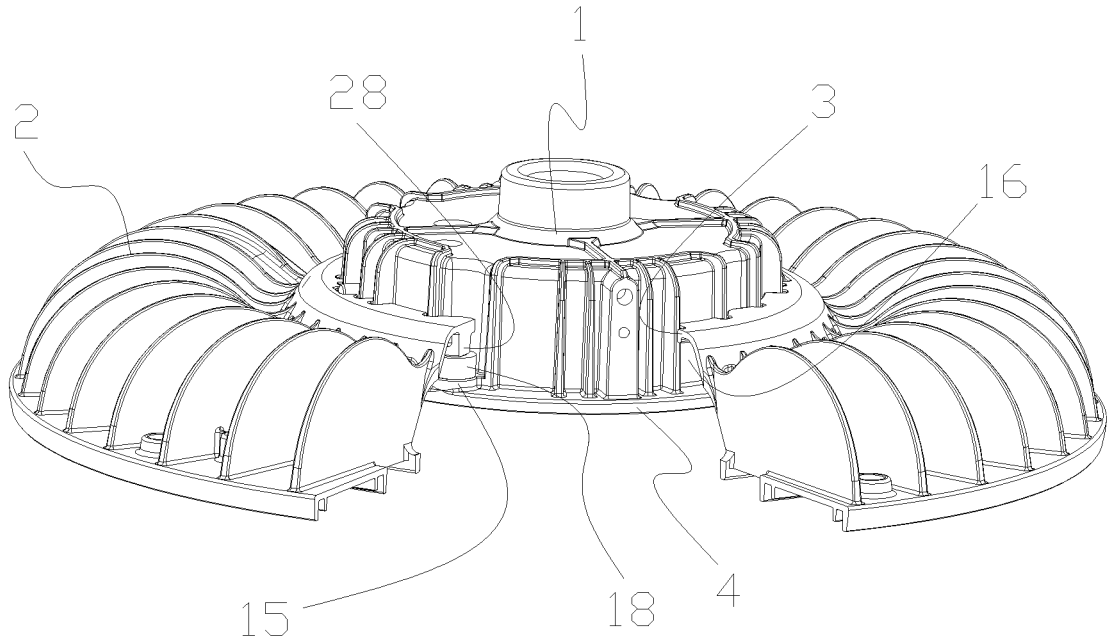
FIG. 2 is a top perspective view of the modular heat dissipation structure according to an embodiment of this disclosure.
Figure 3:
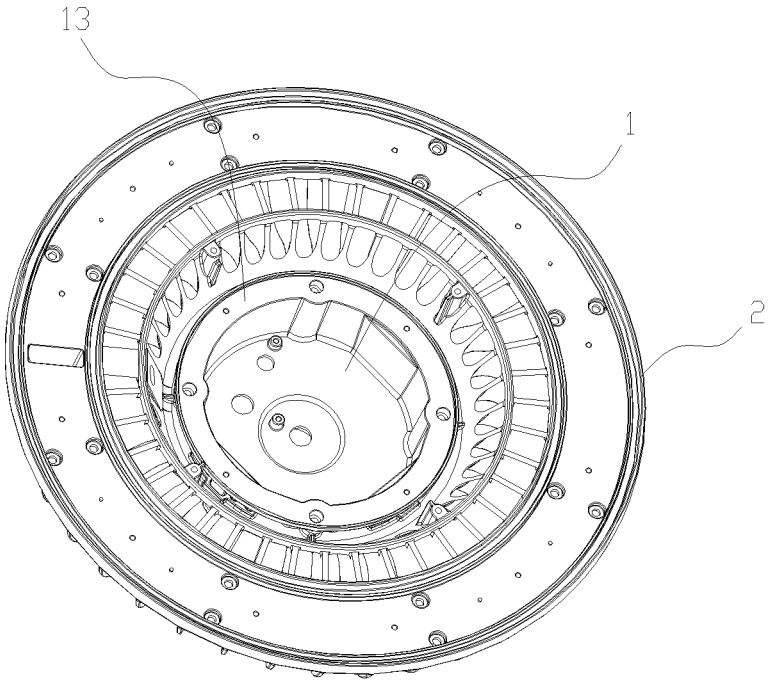
FIG. 3 is a bottom perspective view of the modular heat dissipation structure according to an embodiment of this disclosure.

Please refer to FIGS. 1 to 3, an embodiment of this disclosure provides a modular heat dissipation structure, including a power box 1 and a heat sink 2. The power box 1 is configured to accommodate and dissipate a power supply. The heat sink 2 is configured to dissipate a light source. The heat sink 2 includes a first overlap portion 3, and the power box 1 includes a second overlap portion 4. The first overlap portion 3 is provided on a side of the heat sink 2 opposite to the second overlap portion 4 and is provided corresponding to the second overlap portion 4. The first overlap portion 3 is overlapped above the second overlap portion 4.

In the above heat dissipation structure, the power box 1 and the heat sink 2 adopt a split design and are assembled into a whole, which embodies the idea of modular design and is a modular heat dissipation structure.

Specifically, in the modular heat dissipation structure provided by this embodiment, a first overlap portion 3 is provided on the heat sink 2 and a second overlap portion 4 is provided on the power box 1, so as to connect and fix the heat sink 2 and the power box 1. The first overlap portion 3 is overlapped above the second overlap portion 4, so that weights of the heat sink 2 and components below the heat sink 2 are carried on the second overlap portion 4. The second overlap portion 4 of this disclosure has a stronger bearing capacity than the connection screws used in related lighting devices, in which a large part of the weights needs to be carried on the connection screws.

It should be noted that the above-mentioned modular heat dissipation structure is not limited to the design shape, location and orientation of the first overlap portion 3 and the second overlap portion 4 as described above. For example, in some embodiments, the second overlap portion 4 may be arranged at upper, middle, or lower positions of the power box 1, and the second overlap portion 4 may be arranged to be convex outward or concave inward along a side wall of the power box 1. At this time, the first overlap portion 3 should be arranged at a position matching the second overlap portion 4 and have a matching shape and directionality. In addition, regarding the overlap manner of the first overlap portion 3 and the second overlap portion 4, different implementations are also possible. For example, in some embodiments, the first overlap portion 3 may be overlapped on an upper side of the second overlap portion 4, while in other embodiments, the first overlap portion 3 may also be overlapped inside the second overlap portion 4. The improvement of the above-mentioned modular heat dissipation structure of this embodiment is actually an improvement of the design concept. It improves the heat dissipation structure in related art that requires screw suspension connection to the support connection of the second overlap portion 4, and the second overlap portion 4 actually also is a part of the whole power box 1, thereby improving the load-bearing performance and the safety performance.

Therefore, any structural transformation design of the first overlap portion 3 and the second overlap portion 4 by adopting this design concept belongs to the protection scope of this disclosure.

Further, the first overlap portion 3 includes first bosses 28 spaced apart from each other on a side opposite to the second overlap portion 4, and the second overlap portion 4 includes second bosses 15 corresponding to the first bosses 28 at a side opposite to the first overlap portion 3. Opposite side walls of the first bosses 28 and the second bosses 15 are abutted against each other, so that a heat insulation gap 16 is defined by the first overlap portion 3 and the second overlap portion 4 at a position staggered from the first bosses 28 and the second bosses 15.

The above-mentioned heat insulation gap 16 assists to form an air flow channel where the first overlap portion 3 and the second overlap portion 4 are overlapped, thereby accelerating the air flow and reducing the heat transfer between the first overlap portion 3 and the second overlap portion 4.

Optionally, a heat insulation gasket 18 is further provided between each of the first bosses 28 and the corresponding second boss 15. The heat insulation gasket 18 is made of high heat insulation material, such as silicone sheet, glass-fiber board, etc. The heat insulation gasket 18 is configured to insulate the heat transfer between the first boss 28 and the second boss 15. It should be noted that, in actual use, the overall height of the heat sink 2 and the power box 1 may be adjusted by replacing the heat insulation gasket 18 of different thickness.

When a thicker heat insulation gasket 18 is applied, the overall height of the heat sink 2 and the power box 1 is reduced, thereby reducing the height and the required space of the lighting device, making the structure of the lighting device more compact. At the same time, the above-mentioned heat insulation gap 16 also increases accordingly. The larger the heat insulation gap 16 is, the less the heat transfer between the first overlap portion 3 and the second overlap portion 4 will be, and as the height of the power box 1 decreases, the power supply is closer to a lower temperature environment, which also reduces the operating temperature of the power supply and increases the service life of the power supply.

Embodiment 2

This embodiment provides an application of the above-mentioned modular heat dissipation structure to a high-bay light. It should be understood that this disclosure is not limited to the application to a high-bay light.

Please refer to FIGS. 2 to 10. Specifically, the high-bay light includes a power box 1, a power supply assembly 6, a heat sink 2, a light source assembly 7 and a translucent cover 8. The power supply assembly 6 includes a power supply. The light source assembly 7 includes a light source and a light source board, and the light source is LED lamp beads which are scattered on the light source board.

The heat sink 2 is connected to the power box 1. The power supply is provided in the power box 1, and the light source is connected to the heat sink 2. The power box 1 is configured to accommodate and dissipate the power supply, and the heat sink 2 is configured to dissipate the light source. The power box 1 and the heat sink 2 together form the heat dissipation structure of the LED lighting device.

The high-bay light adopts a vertical up-and-down structure, where the heat sink 2 and the light source assembly 7 are located at a lower part of the light body, and the power box 1 and the power supply assembly 6 are located on an upper part of the light body. The high-bay light further includes a hook 9 or an installation frame 10 which is connected to the power box 1. During installation, the light device is hung on a high position for lighting through the hook 9 or the installation frame 10.

Figure 6:
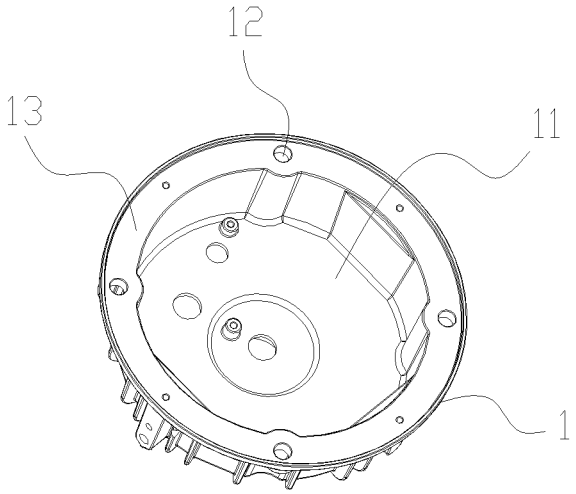
FIG. 6 is a bottom perspective view of a power box according to an embodiment of this disclosure.
Figure 7:
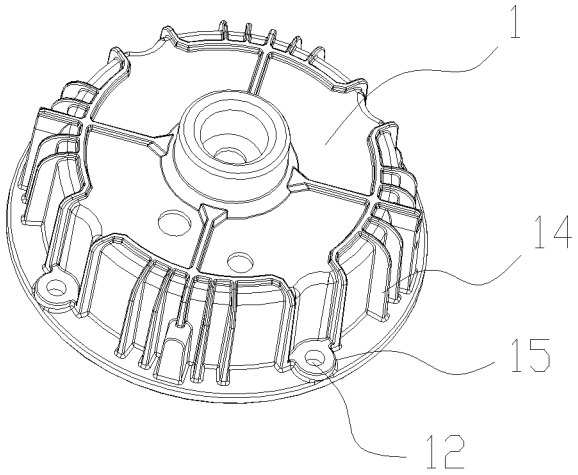
FIG. 7 is a top perspective view of the power box according to an embodiment of this disclosure.
Figure 8:
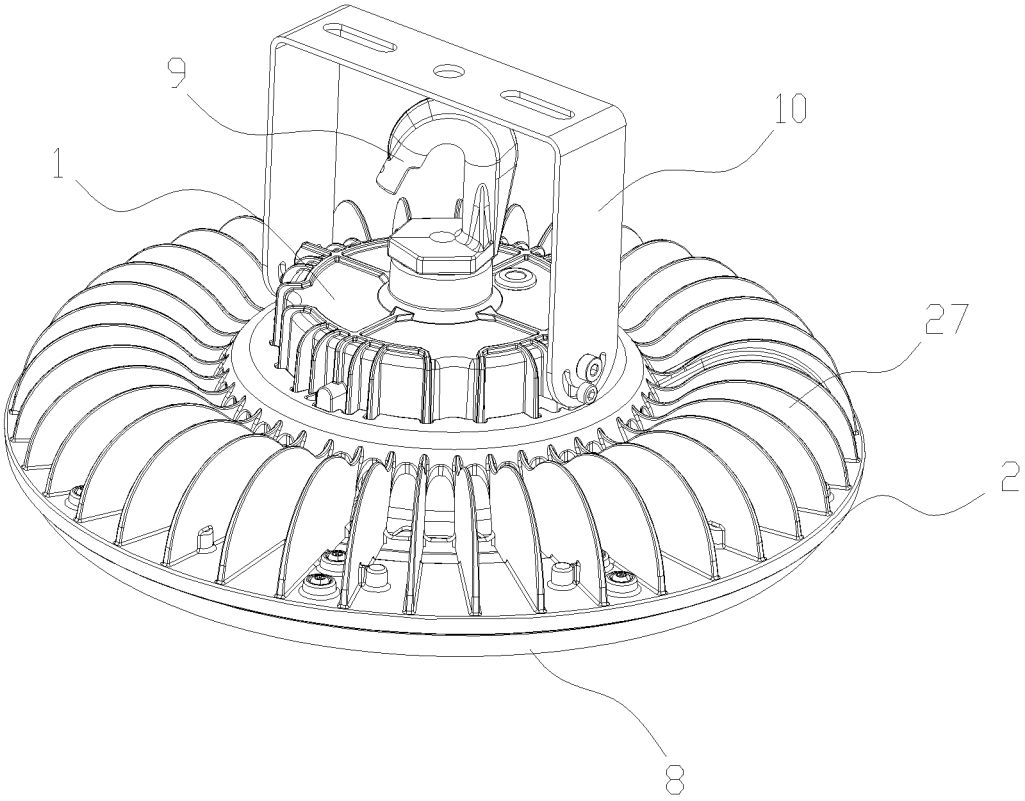
FIG. 8 is a top perspective view of a high-bay light according to an embodiment of this disclosure.
Figure 9:
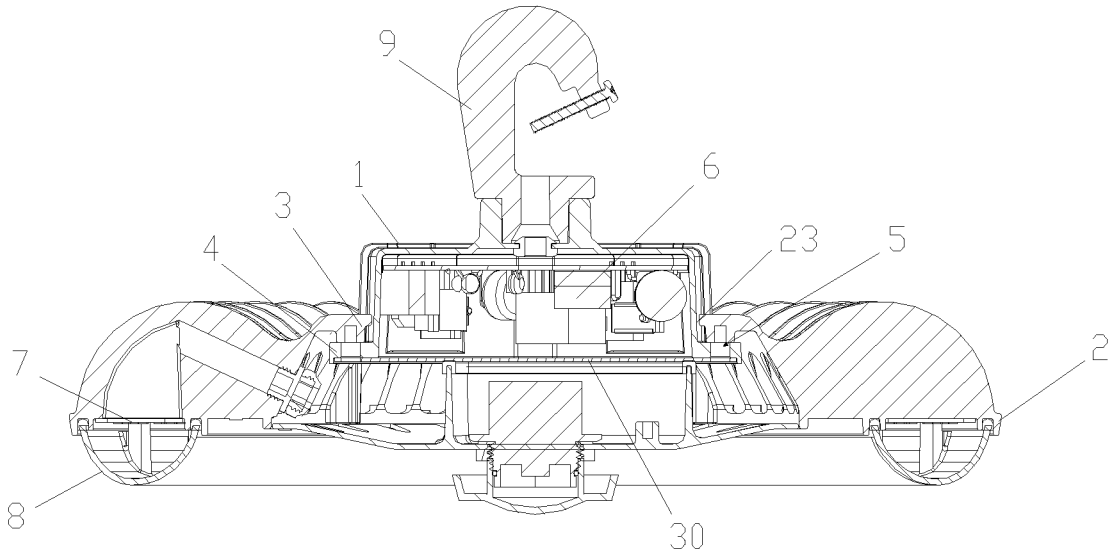
FIG. 9 is a cross-sectional view of the high-bay light according to an embodiment of this disclosure.
Figure 10:
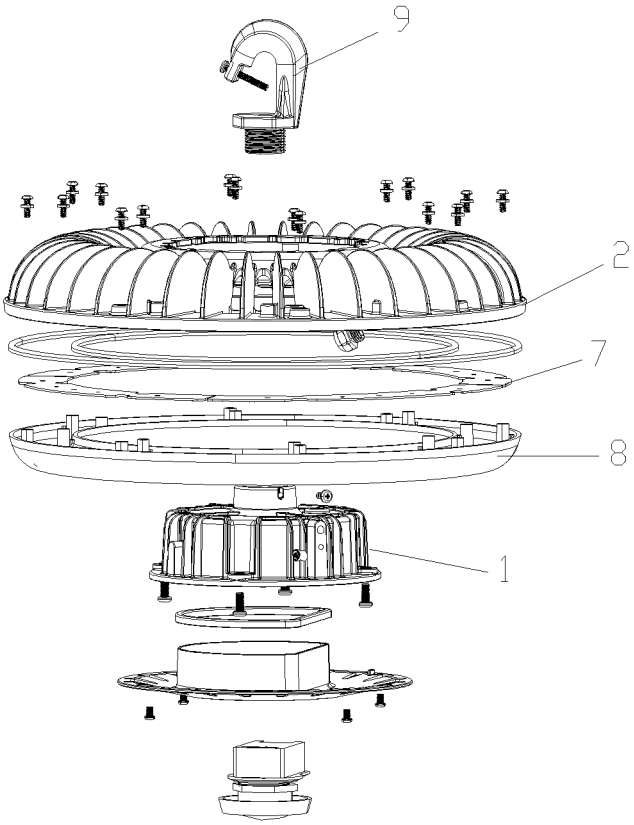
FIG. 10 is an exploded view of the high-bay light according to an embodiment of this disclosure.

Please refer to FIGS. 6, 7, and 9. The power box 1 is a shell made of metal aluminum die-casting which defines a cavity 11 inside and an opening at one end. The power supply assembly 6 is installed in the cavity 11 from the opening and is usually fixed in the cavity 11 by means of infusion of silica gel. The injection of silica gel in the cavity 11 also helps the heat of the power supply assembly 6 to be quickly transferred to the power box 1, which is beneficial to the heat dissipation of the power supply. The power box 1 filled with silica gel is sealed and locked with a cover 30 at the opening.

The power box 1 is provided with a second overlap portion 4, and the second overlap portion 4 is configured as a protrusion ring 13 protruding from an outer periphery of the power box 1. Certainly, in other embodiments, the second overlap portion 4 may also be a protrusion ring 13 that is not a complete circle, but a plurality of protrusion pieces arranged on the outer periphery of the power box 1 in an annular manner.

Figure 4:
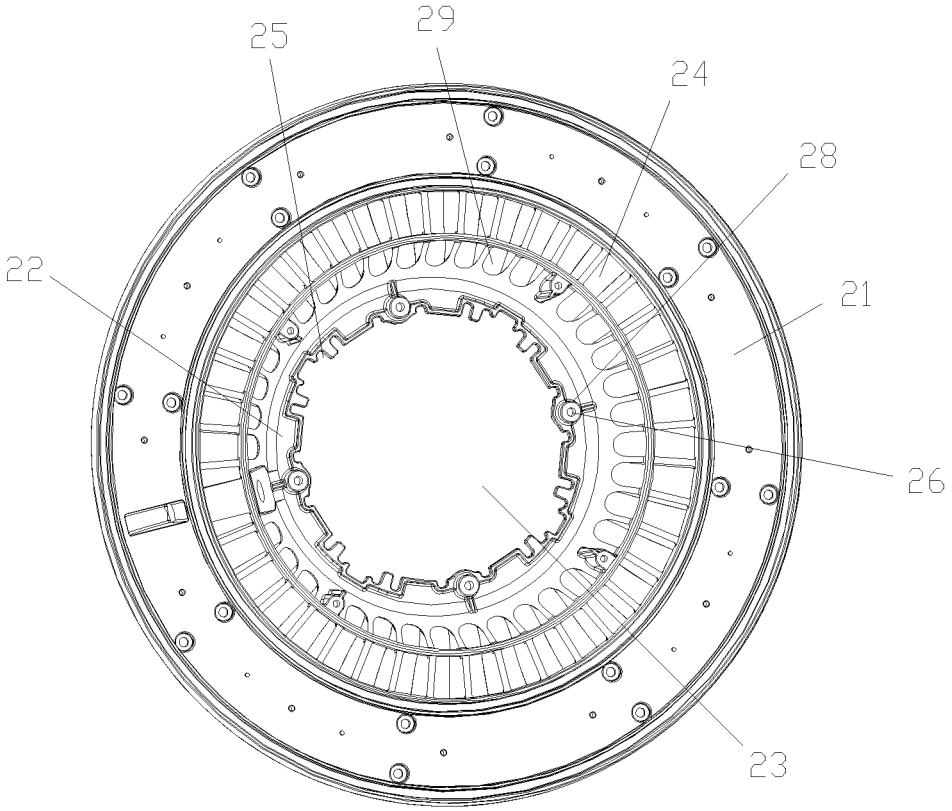
FIG. 4 is a bottom view of a heat sink according to an embodiment of this disclosure.
Figure 5:
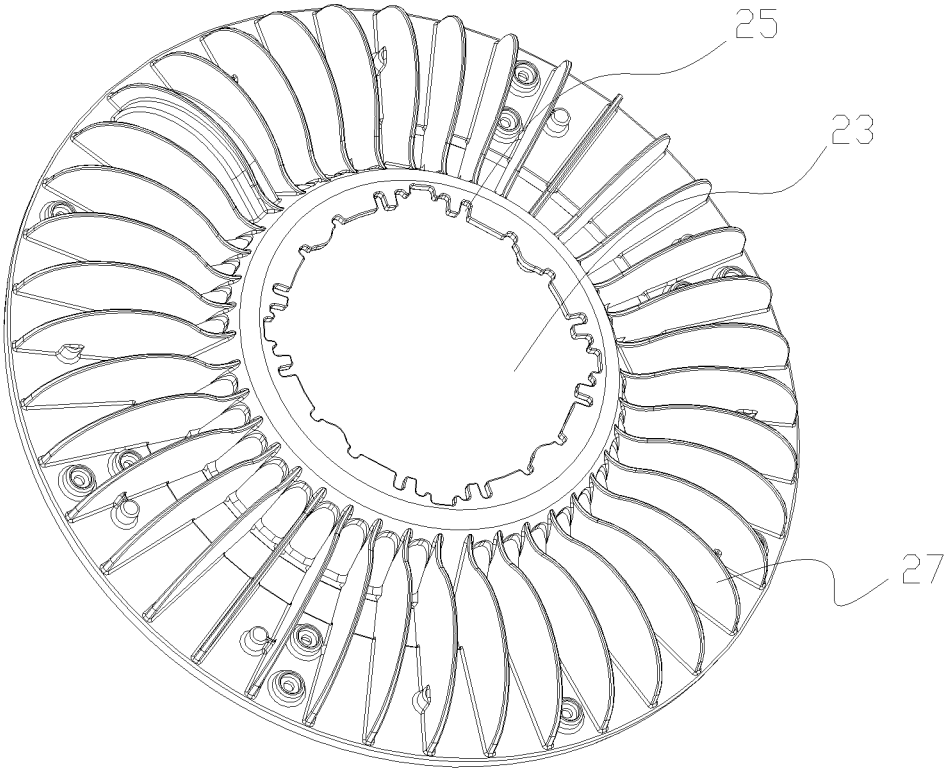
FIG. 5 is a top perspective view of the heat sink according to an embodiment of this disclosure.

Please refer to FIGS. 4, 5, and 9. The heat sink 2 includes a body and heat dissipation fins 27. The body includes a first connection portion 21 and a second connection portion 22, and the first connection portion 21 and the second connection portion 22 are spaced apart from each other. The heat dissipation fins 27 are respectively connected to the first connection portion 21 and the second connection portion 22, so as to define a heat insulation opening 24 between the first connection portion 21 and the second connection portion 22. The first connection portion 21 is configured to connect the light source, and the first overlap portion 3 is provided on the second connection portion 22.

The second connection portion 22 defines an installation notch 23, and the installation notch 23 is configured to fit a cross-sectional shape of the power box 1. The installation notch 23 is configured for an upper end of the power box 1 to pass through to an upper side of the heat sink 2, and a periphery of the installation notch 23 is configured as the first overlap portion 3.

The power box 1 and the heat sink 2 jointly constitute the heat dissipation structure of the high-bay light. When the power box 1 and the heat sink 2 are connected, the power box 1 is passed through the installation notch 23 from a lower side of the heat sink 2 until the protrusion ring 13 is abutted against the periphery of the installation notch 23. At this time, since the protrusion ring 13 is the second overlap portion 4, and the periphery of the installation notch 23 is the first overlap portion 3, the installation requirements for the first overlap portion 3 to be overlapped above the second overlap portion 4 is achieved. Certainly, in this embodiment, the first overlap portion 3 is not directly overlapped above the second overlap portion 4. The first overlap portion 3 includes first bosses 28 spaced apart from each other on a side opposite to the second overlap portion 4, and the second overlap portion 4 includes second bosses 15 corresponding to the first bosses 28 at a side opposite to the first overlap portion 3. Opposite side walls of the first bosses 28 and the second bosses 15 are abutted against each other, so that a heat insulation gap 16 is defined by the first overlap portion 3 and the second overlap portion 4 at a position staggered from the first bosses 28 and the second bosses 15.

After the installation is completed, the power box 1 and the heat sink 2 defines a heat insulation gap 16 at a position of the first overlap portion 3 and the second overlap portion 4 staggered from the first bosses 28 and the second bosses 15, thereby reducing the heat transfer between the first overlap portion 3 and the second overlap portion 4, lowering the operating temperature of the power supply in the power box 1, which is beneficial to improving the life of the power supply.

When the first connection portion 21 is configured to connect the light source assembly 7, since the LED lamp beads are pre-fixed on the light source board, only the light source board needs to be screwed to an underside of the first connection portion 21, and then, the translucent cover 8 is covered on the light source board to protect the light source assembly 7 and transmit light.

The heat sink 2 defines a heat insulation opening 24 between the first connection portion 21 and the second connection portion 22. The heat generated by the light source assembly 7 during operation is directly transferred to the first connection portion 21. In the process of dissipating heat on the body of the heat sink 2 where the first connection portion 21 is located, a side of the first connection portion 21 adjacent to the second connection portion 22 forms an air convection effect, which is beneficial to accelerating the heat loss on the first connection portion 21, thereby reducing the heat conduction between the first connection portion 21 and the second connection portion 22, that is, reducing the heat transfer from the light source of the lighting device to the power box 1. Therefore, this disclosure has better heat dissipation performance, the heat of the light source has little influence on the power supply, and the overall service life of the power supply and the lighting device is extended.

In this embodiment, the first connection portion 21 is located on the outer side of the high-bay light in an annular manner, and the second connection portion 22 is located in an inner middle area of the high-bay light, so that the first connection portion 21 and the second connection portion 22 are staggered in the vertical direction, so a lower area corresponding to the power box 1 connected at the second connection portion 22 and its internal power supply is less affected by the heat generated by the light source assembly 7. Compared to most high-bay lights on the market in which the power supply assembly and the light source assembly are arranged vertically in the vertical direction, this design may make the area directly below the power supply assembly 6 of the high-bay light stay in a relatively low temperature environment for a long time, reducing the influence of high temperature environment on the service life of the power supply assembly 6 and improving the service life of the power supply assembly 6.

Please refer to FIG. 2. In addition, the power box 1 includes heat dissipation ribs 14 at least on a side wall opposite to the installation notch 23, and the installation notch 23 defines grooves 25 adapted to the heat dissipation ribs 14 on a peripheral wall corresponding to the heat dissipation ribs 14. The heat dissipation ribs 14 are partially embedded in the grooves 25. The heat dissipation ribs 14 are configured to improve the heat dissipation performance of the power box 1. At the same time, the heat dissipation ribs 14 are fitted and embedded into the grooves 25, so that the heat dissipation ribs 14 play a dual role of limiting and guiding when the power box 1 is penetrated through the installation notch 23, thus improving the operation convenience when the power box 1 is penetrated through the installation notch 23.

Please refer to FIG. 1 or 9, a fastening structure 5 is provided between the first overlap portion 3 and the second overlap portion 4. The fastening structure 5 is configured to position and fix the first overlap portion 3 with the second overlap portion 4 at a set position, so as to limit an axial movement and a circumferential movement between the power box 1 and the heat sink 2. In addition, the fastening structure 5 may adopt a fixing method such as a fixing bolt, a fixing bayonet, and a fixing buckle. It is understandable that, on the premise that the first overlap portion 3 and the second overlap portion 4 are overlapped and connected, in order to improve the fixation of the overlap of the first overlap portion 3 and the second overlap portion 4, the fastening structure 5 is adopted for fixation to prevent misalignment or movement between the first overlap portion 3 and the second overlap portion 4, thus improving the installation fixability of the lighting device.

In a specific embodiment, the fastening structure 5 is configured as a screw fastening structure, that is, a fixing method of fixing bolts is adopted. The screw fastening structure 5 includes a bolt, a via 12 defined on the second connection portion 22, and a screw hole 26 defined on the first connection portion 21. The bolt is passed through the via 12 to be threadedly connected with the screw hole 26. According to the high-bay light of this disclosure, the screw hole 26 is defined on the first boss 28 on the first connection portion 21, and the corresponding via 12 is defined on the second boss 15 on the second connection portion 22. The screw hole 26 is defined on the first boss 28, the via 12 is defined on the second boss 15, and the first bosses 28 and the second bosses 15 are arranged opposite to each other, so that when the heat sink 2 is connected to the power box 1, the first bosses 28 are overlapped above the second bosses 15. The above-mentioned heat insulation gap 16 is defined at the peripheries of the protrusion ring 13 and the installation notch 23, so as to further be beneficial to the heat insulation effect between the heat sink 2 and the power box 1.

Further, the second connection portion 22 defines a heat dissipation opening 29. The heat dissipation opening 29 is communicated with the heat insulation gap 16 to accelerate the air flow in the heat insulation gap 16 and improve the heat dissipation performance.

In addition, a heat insulation gasket 18 may be further provided between the overlapped first boss 28 and the second boss 15 to further improve the heat insulation effect. The heat insulation gasket 18 may be a silicone gasket, fiberglass board, etc. It is understandable that by increasing or decreasing the thickness of the heat insulation gasket 18, the overall height of the heat sink 2 and the power box 1 may be adjusted, thereby adjusting the overall height of the high-bay light.

In order to further illustrate the influence of the thickness of the heat insulation gasket 18 on the service life of the power supply, this embodiment is described by the following test data.

It is understandable that the lower the working temperature of the power supply, the longer the service life of the power supply. According to the high-bay light of this disclosure, due to the overlap arrangement of the power box 1 and the heat sink 2, the relative position of the power box 1 and the heat sink 2 is adjustable, so that the power supply may be operated at a lower working temperature, which is beneficial to extending the service life of the power supply.

Suppose ambient temperature is Ta, working temperature of power supply is Tc, and thickness of heat insulation gasket is H, the following data table is obtained through practical measurement.

| Heat insulation gasket thickness H (mm) | 0 mm (no heat insulation gasket) | 2 mm heat insulation gasket | 10 mm heat insulation gasket | 20 mm heat insulation gasket |
|---|---|---|---|---|
| Ambient temperature of whole light Ta (° C.) | 50 | 50 | 50 | 50 |
| Operating temperature of power supply Tc (° C.) | 89 | 86 | 83 | 81 |

It can be seen from the above table that the thicker the heat insulation gasket 18 is designed, the lower the working environment temperature of the power supply is, and the more helpful it is to extend the service life of the power supply.

It is understandable that, in the high-bay light disclosed above, the first overlap portion 3 and the second overlap portion 4 are selected by adopting better or simpler design principles. In fact, in order to achieve part of the effect of this disclosure, the arrangement of the first overlap portion 3 and the second overlap portion 4 only need to satisfy the following condition: that is, the first overlap portion 3 is provided on a peripheral side of the installation notch 23, the second overlap portion 4 is protruded outside the power box 1, and the power box 1 is at least partially penetrated the installation notch 23 so that the first overlap portion 3 is overlapped above the second overlap portion 4.

In summary, this disclosure is convenient to install, has high safety performance during use, and has good heat dissipation performance. The heat of the light source has little effect on the power supply, and the overall service life of the power supply and the lighting device is extended.

Although the preferred embodiments of this disclosure have been described, those skilled in the art can make other changes and modifications to these embodiments once they know the basic inventive concepts. Therefore, the enclosed claims are intended to be construed to include the preferred embodiments and all changes and modifications that fall within the scope of this disclosure. Obviously, those skilled in the art can make various changes and modifications to this disclosure without departing from the spirit and scope of this disclosure. In this way, if these modifications and variations of this disclosure fall within the scope of the claims of this disclosure and their equivalent technologies, this disclosure is also intended to include these modifications and variations.

What is claimed is:

1. A modular heat dissipation structure, comprising:

a power box, configured to accommodate and dissipate a power supply; and a heat sink, configured to dissipate a light source;

wherein the heat sink comprises a first overlap portion, the power box comprises a second overlap portion, the first overlap portion is provided on a side of the heat sink opposite to the second overlap portion and is provided corresponding to the second overlap portion, and the first overlap portion is overlapped above the second overlap portion;

wherein the first overlap portion comprises first bosses spaced apart from each other on a side opposite to the second overlap portion, the second overlap portion comprises second bosses corresponding to the first bosses at a side opposite to the first overlap portion, opposite side walls of the first bosses and the second bosses are abutted against each other, so that a heat insulation gap is defined by the first overlap portion and the second overlap portion at a position staggered from the first bosses and the second bosses.

2. The modular heat dissipation structure of claim 1, wherein a heat insulation gasket is further provided between each of the first bosses and a corresponding second boss.

3. The modular heat dissipation structure of claim 1, wherein the heat sink comprises:

a body, comprising a first connection portion and a second connection portion spaced apart from the first connection portion; and heat dissipation fins, respectively connected to the first connection portion and the second connection portion to define a heat insulation opening between the first connection portion and the second connection portion;

wherein the first connection portion is configured to connect the light source, and the first overlap portion is provided on the second connection portion.

4. The modular heat dissipation structure of claim 3, wherein the second connection portion defines an installation notch configured for an upper end of the power box to pass through to an upper side of the heat sink, and a periphery of the installation notch is configured as the first overlap portion.

5. The modular heat dissipation structure of claim 4, wherein the power box comprises a protrusion ring on a side wall, and the protrusion ring is configured as the second overlap portion.

6. The modular heat dissipation structure of claim 5, wherein the power box comprises a heat dissipation rib at least on a side wall opposite to the installation notch, the installation notch defines a groove adapted to the heat dissipation rib on a peripheral wall corresponding to the heat dissipation rib, and the heat dissipation rib is partially embedded in the groove.

7. The modular heat dissipation structure of claim 1, wherein a fastening structure is provided between the first overlap portion and the second overlap portion to limit an axial movement and a circumferential movement between the power box and the heat sink.

8. The modular heat dissipation structure of claim 3, wherein the second connection portion defines a heat dissipation opening.

9. An LED lighting device, comprising a modular heat dissipation structure, wherein the heat dissipation structure comprises:

a power box, configured to accommodate and dissipate a power supply; and a heat sink, configured to dissipate a light source;

wherein the heat sink comprises a first overlap portion, the power box comprises a second overlap portion, the first overlap portion is provided on a side of the heat sink opposite to the second overlap portion and is provided corresponding to the second overlap portion, and the first overlap portion is overlapped above the second overlap portion;

wherein the first overlap portion comprises first bosses spaced apart from each other on a side opposite to the second overlap portion, the second overlap portion comprises second bosses corresponding to the first bosses at a side opposite to the first overlap portion, opposite side walls of the first bosses and the second bosses are abutted against each other, so that a heat insulation gap is defined by the first overlap portion and the second overlap portion at a position staggered from the first bosses and the second bosses.

10. The LED lighting device of claim 9, wherein a heat insulation gasket is further provided between each of the first bosses and a corresponding second boss.

11. The LED lighting device of claim 9, wherein the heat sink comprises:

a body, comprising a first connection portion and a second connection portion spaced apart from the first connection portion; and heat dissipation fins, respectively connected to the first connection portion and the second connection portion to define a heat insulation opening between the first connection portion and the second connection portion;

wherein the first connection portion is configured to connect the light source, and the first overlap portion is provided on the second connection portion.

12. The LED lighting device of claim 11, wherein the second connection portion defines an installation notch configured for an upper end of the power box to pass through to an upper side of the heat sink, and a periphery of the installation notch is configured as the first overlap portion.

13. The LED lighting device of claim 12, wherein the power box comprises a protrusion ring on a side wall, and the protrusion ring is configured as the second overlap portion.

14. The LED lighting device of claim 13, wherein the power box comprises a heat dissipation rib at least on a side wall opposite to the installation notch, the installation notch defines a groove adapted to the heat dissipation rib on a peripheral wall corresponding to the heat dissipation rib, and the heat dissipation rib is partially embedded in the groove.

15. The LED lighting device of claim 9, wherein a fastening structure is provided between the first overlap portion and the second overlap portion to limit an axial movement and a circumferential movement between the power box and the heat sink.

16. The LED lighting device of claim 11, wherein the second connection portion defines a heat dissipation opening.

* * * * *